US005131986A

United States Patent [19]

Harada et al.

[11] Patent Number: 5,131,986

[45] Date of Patent: Jul. 21, 1992

[54] GOLF CLUB HEAD AND ITS MANUFACTURING

[75] Inventor: Mutsumi Harada; Takashi Iijima; Toshi haru Hoshi Kenzaburou Iijima, all of Hamamatsu, Japan

[73] Assignee: Yamaha Corporation, Hamamatsu, Japan

[21] Appl. No.: 620,714

[22] Filed: Dec. 3, 1990

[30] Foreign Application Priority Data

Dec. 1, 1989 [JP] Japan ..... 1-312570
Feb. 2, 1990 [JP] Japan ..... 2-23909

[51] Int. Cl.[5] ..... C25D 1/02; A63B 53/04
[52] U.S. Cl. ..... 205/67; 278/167 H
[58] Field of Search ..... 204/3, 4, 6; 273/167 R, 273/167 H

[56] References Cited

U.S. PATENT DOCUMENTS 3,847,399 11/1974 Raymont ..... 273/167 F
4,930,781 6/1990 Allen ..... 273/167 F

*Primary Examiner*—T. M. Tufariello
*Attorney, Agent, or Firm*—Burns, Doane, Swecker & Mathis

[57] ABSTRACT

This invention concerns a new type of golf club head bodies produced by electrolytic deposition of metals, alloys and electrolytic codeposition of metal-matrix composite materials. The golf club heads so produced are comparatively free from structural defects, thus enabling production of high performance golf clubs having thin-walled heads to provide both lightness and strength.

22 Claims, 4 Drawing Sheets

GOLF CLUB HEAD AND ITS MANUFACTURING

FIELD OF THE INVENTION

This invention relates to golf club heads, in particular, the dirver, the brassie, the spoon, the baffy and cleek, the so-called metal wood type heads, and the method of manufacturing the same.

BACKGROUND OF THE INVENTION

The golf club heads made of wood, such as those used for drivers and spoons, are becoming less popular than newer metal heads which are replacing the heads made from the conventional persimmon wood.

Most of such metal heads have been made of cast stainless steels, or aluminum alloys utilizing a process known as the lost-wax casting process.

However, as far as casting methods are concerned, it is impossible to eliminate porosity defects, and consequently, it is difficult to reduce weight by thinning the wall thickness.

Furthermore, although it is desirable to vary the local wall thicknesses of the various parts, such as the sole, the crown and the face, of the head for proper balance, the precision level required in producing these different thickness walls falls within the manufacturing tolerance of the walls, and therefore, it has been difficult to manufacture ideally balanced heads.

This invention was made to solve such problems of heads and their manufacturing methods by utilizing electrolytic deposition methods of metals and metal composites, thereby to improve the wall thickness distribution to improve the directionality and the distance of the gold ball flight.

SUMMARY OF THE INVENTION

By utilizing the technique of electrolytic deposition of metals, in particular speciality metals such as chromium which has not been utilized for making metal heads because of manufacturing difficulties, and metal-matrix composite materials (hereinafter referred to as metal composite materials , it is possible to produce thin-walled metal wood heads free from casting defects.

Furthermore, the technique permits production of different local wall thicknesses by varying the combination of operating parameters such as the electrode distance, adjustments in the flow of electrolytic solution, and current densities in the various parts of a head during the manufacturing process, it becomes possible to custom fabricate high performance heads.

DETAILED DESCRIPTION OF THE PREFERRED EMBODIMENTS

In the following description of the present invention, a head refers to a completed head which is attached to a golf club, and a head body refers to an in-process article of manufacture. A head object is an object to be reproduced by a technique described in this invention which includes a technique of electrolytic deposition of metals and metal composite materials.

The basic method of manufacturing the head bodies is described in the following.

1. An outer electrode and an inner electrode having a conjugate and a proportional shapes, respectively, to the shape of the head object are prepared.
2. The inner electrode is placed inside of and at a certain distance away from the outer electrode.
3. The space between the two electrodes is filled with an electrolytic solution.
4. Electrolytic deposition operation is carried out.
5. The process of electrolytic deposition consists essentially of depositing a metal, metal alloys or a metal composite material on an electrode to form a head body.

The following describes a process utilized in a preferred embodiment of this invention.

The first step is to reproduce a duplicate model of the head object, having the identical outer configuration and dimensions of the head object, by machining a polymeric material body.

The next step is to make an outer electrode whose inner surface reproduces the external configuration of the model exactly. This is achieved by the following procedure. The model is sprayed with a separator solution to facilitate the separation of a duplicating coating containing such polymerizable materials as prepolymer of methylmethacrylate liquid acrylic resin, uncured epoxy resin, unsaturated polyester, urethane and other suitable polymerizable materials, and after the coating has hardened, it is split into two sections to take out the model. A suitable metal film such as nickel film is deposited on the interior surface of the coating by electroless deposition technique. The outer electrode thus produced serves to reproduce the external configuration of the head exactly because of the conductive nature of the metal film.

Further, the outer electrode has more than one parting lines so as to be able to place an inner electrode within it.

The next step is to produce an inner electrode of suitably smaller overall size and shape than those of the model. The material of construction is plastic or metal and the shape is reproduced by molding o casting. The external surface of the inner electrode thus produced is covered with a metal film such as platinum or other conductive material by electrolytic methods. The external dimensions of this inner electrode do not duplicate the external dimensions of the model exactly.

Figure 1:
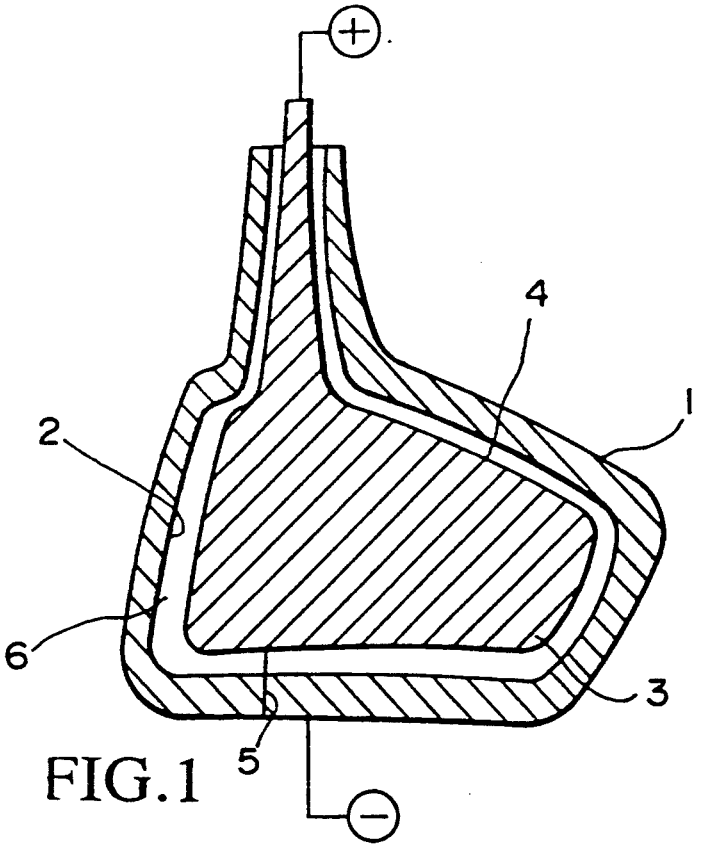
FIG. 1 is a schematic drawing of the cross section of a paired combination of an inner and an outer electrodes of a preferred embodiment of this invention.

Next, the outer and inner electrodes are placed face to face as shown in FIG. 1. In this figure are shown an outer electrode 1, an electrode surface 2 of the said electrode 1, an inner electrode 3, an electrode surface of said body 4 and a parting line 5. The support and the electrode contact for the inner electrode 3 are made at the hosel section by means of jigs (not shown) and similar arrangements (not shown) are made for the outer electrode 1. The surfaces of the jigs are covered with polymeric materials such as Teflon (du Pont) to prevent the deposition of metallic constituent materials.

The distance of a space 6 between the outer electrode 1 and the inner electrode 3 is usually within 10 mm and is possible to be varied at desired locations such as the face, crown and sole. The short distance promotes thicker deposition.

The deposition process is carried out in this condition by making the outer electrode 1 an anode and the inner electrode a cathode and by passing direct current through the space 6., The metals and alloys which can be deposited by this arrangement include Ni, Ni-Co alloys, Ni-P alloys, Fe, Cr, and FeCrNi alloys and further include metal composite materials containing such additives as fine particles of SiC to be codeposited with Ni. Suitable electrolytic solutions are selected according to the type of material desired, which include sulfamic acid (Ni) plating bath suitable for thick deposits and Sargent plating bath containing chromic and sulfuric acids. When metal composite materials is desired, a desirable electrolytic solution containing desirable fine particles can be used, preferably a sulfamine electrolyte containing a dispersion of fine non-metallic particles such as SiC in the case of a Ni-SiC composite. The bath temperature differs depending on the type of electrolyte, but usually it is in the range of 20° to 60° C. The current density is preferably between 1 to 200 amperes/dm$^2$. The injection of the electrolyte can be carried out at suitable locations, such as between the space 6 at the hosel or by placing a throughole on the outer electrode 1 to correspond with the sole section and passing the electrolyte through the hosel space.

The process as described above permits a deposition of metals and metal composite materials on the internal electrode surface 2 of the outer electrode 1.

After passing the current for a suitable period of time, the electrolyte is drained from the space 6 and the electrodes 1 and 3 are removed to take out the head body which has the desired material deposited on. The methods of removing the outer electrode 1 include heating to thermally decompose the plastic while the inner electrode 3 can be removed by dissolving in acids if it is a metal and by heating if it is a plastic.

The metal head body thus produced is a shell body of vacant interior, and its surface is covered with thin film of the metal constituting the electrode surface 2 of the external electrode 1.

According to this method of production, it is possible to duplicate exactly the surface configuration of the electrode surface 2 of the outer electrode 1, and therefore it becomes possible to prepare patterns on the electrode surface 2 to correspond with scoring lines of the face of the head. It is also possible to duplicate accurately features such as face, bulge and roll, to minimize machining requirements.

Figure 2:
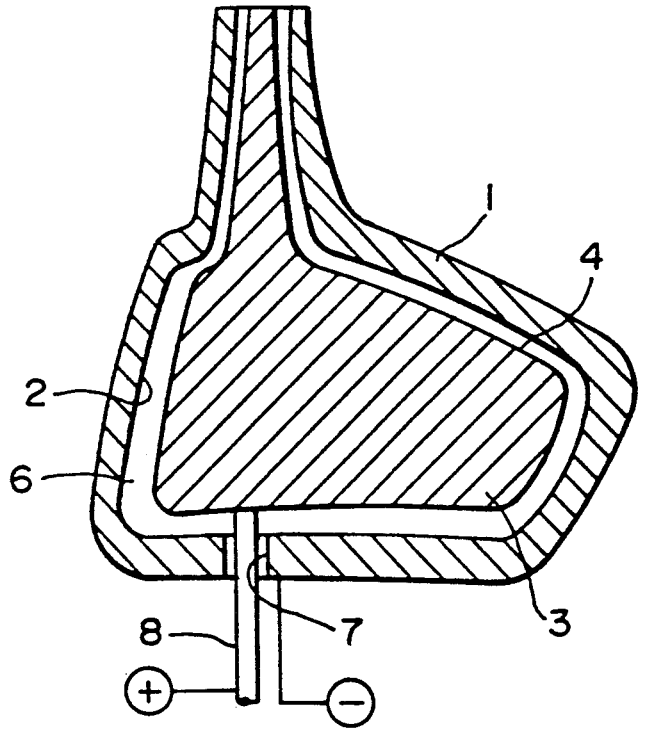
FIG. 2 is a similar drawing for a similar combination for another preferred embodiment of this invention.

FIG. 2 illustrates another preferred embodiment of this invention. In this case, a throughhole 7 is provided on the region corresponding to the sole on the outer electrode 1, and a metal rod jig 8, which serves as a support for the inner electrode 3 and as an electrical contact, is provided for the region corresponding to the sole of the inner electrode 3. As shown in FIG. 2, the rod jig 8 passes through the throughole 7 in such a way to avoid contacting the regions surrounding the throughole 7. In this case, it becomes possible to transfer the electrolyte in or out through said throughole 7. In this technique, a hole is left in the head body where the rod jig 8 was located during processing, however, this hole can be used to attach balancing weight.

Another preferred embodiment is explained below. In this case, an inner electrode 3 having the identical configuration as the head is made so that it is smaller by the thickness of the head.. This is accomplished by machining an epoxy body to size, for example, and by depositing a metal film, such as Ni, on the surface by electroless plating. Therefore, this inner electrode 3 is proportional to the exterior dimensions of the head.

An outer electrode 1 is made next. This electrode 1 has a conjugate configuration to the exterior surface of the head, and does not need to be a unit body. In fact, it is preferable that it can be divided into two or more sections. The electrode 1 can be made by stamping a strip material of platinum or by polymeric material whose interior surface is coated with Ni by electroless plating and additionally treated with platinum plating.

Figure 3:
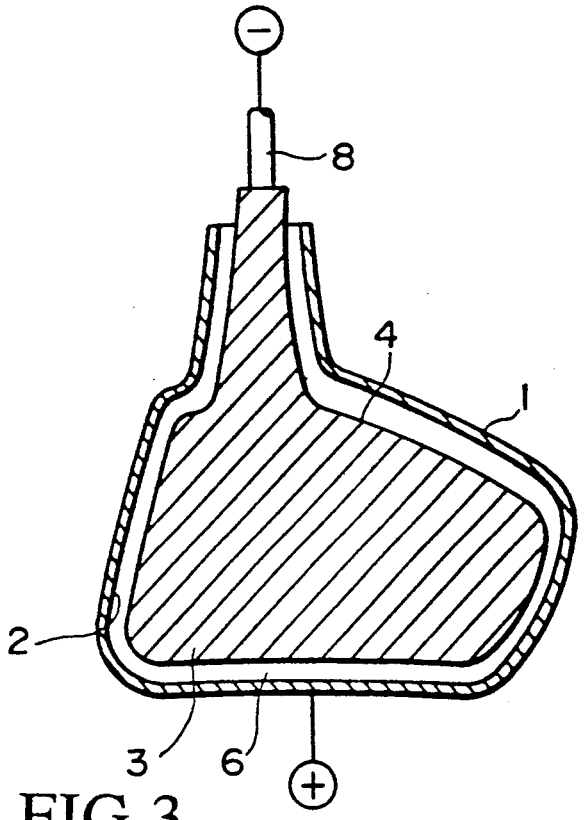
FIG. 3 is another similar drawing for another preferred embodiment of this invention.

Next, the outer electrode 1 and inner electrode 3 are placed as shown in FIG. 3. The support and electrical contact are provided for on the outer electrode 1 by a jig (not shown) and the support and electrical contact are provided for on the hosel part for the inner electrode 3 by means of a metal jig 8. Such a jig can be made out of aluminum covered with a fluorocarbon polymers.

The distance of the space 6 between the outer and inner electrode is less than 10 mm as in the previous cases.

Next, electrodeposition is carried out by making the outer electrode 1 an anode and the inner electrode 3 a cathode and by passing direct current between the space 6 to deposit metal alloys and metal composite materials on the interior surface 4 of the inner electrode 3.

After passing the current for a suitable period of time, the electrolyte is drained from the space 6 and the electrode 1 is removed and the electrode 3 is removed by heating, for example, to take out the head body which has the desired material deposited on.

The advantage of this method is that the electrode 1 can be reused many times. Further, if the inner electrode 3 is made from foamed polymers such as foamed polyurethane, foamed polystyrene, then the inner material need not be removed because the form-filled club is light weight and, furthermore, the striking sound of such a club is also improved. Of course, if desired, the electrode can be removed easily.

Figure 4:
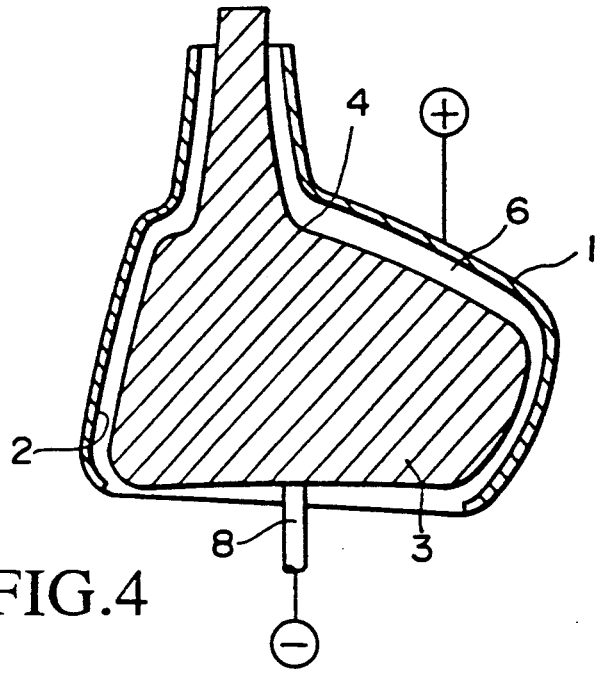
FIG. 4 is another similar drawing for another preferred embodiment of this invention.

FIG. 4 shows a preferred embodiment, wherein the head face and crown are made as one body by the invented technique while the sole is made by another suitable method, and the latter can be attached to the rest by such joining means as electric welding.

Therefore, the outer electrode 1 used in this embodiment is lacking the part of the mold corresponding to the sole. The support and electrical contact for the inner electrode 3 are made by attaching a metal jig 8 on the part which would correspond with the sole. The advantage of this method is that the head balance can be adjusted sensitively by making the sole from another material.

The local wall thicknesses of such a head body can be adjusted finely to achieve a head having a finely tuned thin-walled head body.

Another preferred embodiment is explained in the following. In this technique, either the outer electrode 1 or the inner electrode 3 is made into several sections of partial sectional electrodes.

Figure 5:
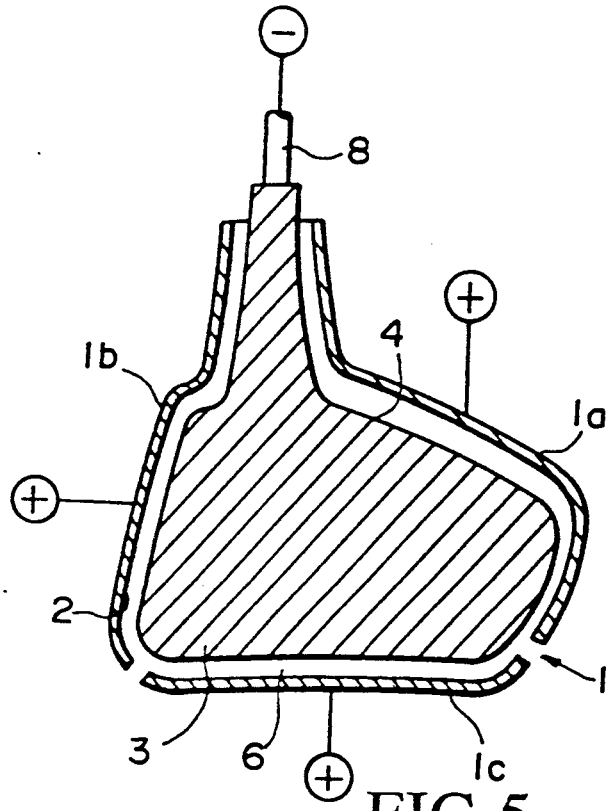
FIG. 5 is another similar drawing for another preferred embodiment of this invention.

In FIG. 5, the outer electrode 1 has been divided into three component sections corresponding to a crown section 1*a*, a face section 1*b* and a sole section 1*c*. The sectional electrodes 1*a*, 1*b* and 1*c* are each provided with a metal jig (not shown) to serve as a support and electrical contact so that each section can be supplied with current independently.

A space is provided between each of said sectional electrode 1*a*, 1*b* and 1*c* so that the electrolyte can be passed through. The support and the electrical contact is provided to the inner electrode 3 at the hosel section by means of a metal jig 8.

The current is applied to the outer electrode 1 to each of the sectional electrodes 1*a*, 1*b* and 1*c* independently to control the thickness of the various sections of the head and to produce a head body having desired section thickness, by the using the following processes in combination or individually; for example varying the current densities to each of the sectional electrodes 1*a*, 1*b* and 1*c*; varying the distances of the space 6 between the inner electrode 3 and the sections 1*a*, 1*b* and 1*c*; varying the flow volume of the electrolyte to each of the sectional electrodes 1*a*, 1*b* and 1*c*; to control the amount of deposition of metal and metal composite materials in the various sections.

Figure 6:
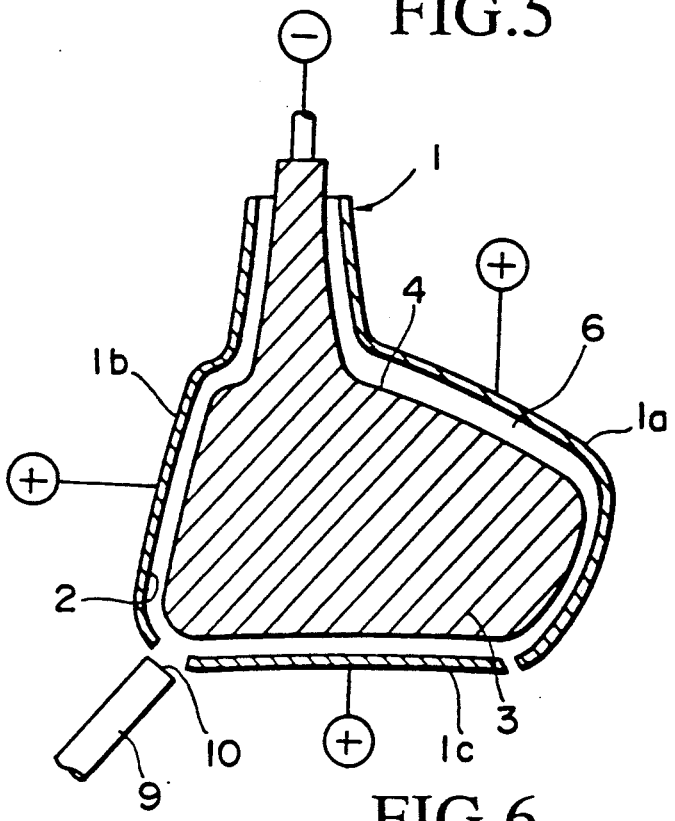
FIG. 6 is another similar drawing for another preferred embodiment of this invention.

To vary the current densities to sectional electrodes 1*a*, 1*b* and 1*c*, each of the electrodes 1*a*, 1*b* and 1*c* can be provided with an electrical contact and an independent current control means. The electrolyte flow volume can be varied by disposing an electrolyte delivery tube, as shown in FIG. 6, at the space between each of the sectional electrode 1*a*, 1*b* and 1*c* and by varying the flow volume independently.

By adapting such techniques, it is possible to control the deposit thicknesses independently and freely in the various sections of the head body as required.

The head thus produced has varying wall thicknesses in the desired sections. For example, the wall thickness in the face and sole is controlled in the range of 2 to 3 mm, and that of the crown in the range of 0.4 to 0.8 mm. The achievement of such a thin wall at the crown is made possible by the use of the electrolytic deposition technique. Further, the long drive performance and the directionality of the head are improved by having a thin-walled crown which deforms slightly on impact to impart a ball an extra driving energy and directional stability. It is permissible to fill the vacant inner space of such a head with foamed polymers and resins.

This invention is applicable not only to so-called metal wood heads such as the driver, the brassie, the spoon, the baffy, the cleek but also to hollow iron heads.

In particular, chrome heads can be made even thinner because chrome has about 35% higher elastic modulus per unit density than those of stainless and aluminum alloys.

FIRST PREFERRED EMBODIMENT

A first preferred embodiment was made by arrangement shown in FIG. 1 to produce a head for the driver No. 1. The outer electrode 1 was made of epoxy resin having an electrode surface 2 made of electroless nickel, and the inner electrode 3 was made of aluminum having an electrode surface 4 of electrodeposited platinum.

The outer electrode 1 and the inner electrode 3 were arranged as shown in this figure, and the electrode distance 6 at the sole section was 5 mm while the distance 6 at the crown section was 10 mm.

The chrome electrolyte was Sargent plating bath and the deposition conditions were electrolytic bath temperature of 50° C. and the average current density of 100 A/dm$^2$.

After the deposition operation is completed, the outer electrode 1 was thermally decomposed and the inner electrode 3 was chemically dissolved by nitric acid, and the remaining thin film of platinum was removed with a pair of tweezers.

The wall thicknesses in the various sections of the chrome head body thus produced were measured as follows: 2.5 to 3 mm in the face and the sole sections, and 0.4 to 0.6 mm in the crown section.

SECOND PREFERRED EMBODIMENT

A second preferred embodiment was made with an arrangement as shown in FIG. 5.

The outer electrode 1 consisted of a sectional crown electrode 1*a*, a sectional face electrode 1*b* and a sectional sole electrode 1*c*, all of which were made of press formed platinum sheet. The inner electrode 3 was made of epoxy resin having an electrode surface 4 composed of electroless nickel deposit. The electrolytic deposition conditions were the same as in the first preferred embodiment.

The deposition current to each of the sectional electrodes 1*a*, 1*b* and 1*c* of the outer electrode 1 was controlled independently, and the current densities in the face electrode 1*b* and in the sole electrode 1*c* were 200 A/dm$^2$, and the current density in the crown electrode 1*a* was 50 A/dm$^2$. The electrode distance between the outer electrode 1 and the inner electrode 3 was 10 mm throughout. The head thus produced yielded the following wall thickness measurements: 2.4 to 3.0 mm at the face and sole regions and 0.3 to 0.5 mm at the crown region.

THIRD PREFERRED EMBODIMENT

A third preferred embodiment is presented below. The current densities in the outer sectional electrode 1*a*, 1*b* and 1*c* were made to be the same as in the second preferred embodiment at 200 A/dm$^2$ and electrolyte flow to face electrode 1*b* and to the sole electrode 1*c* was increased while that to the crown electrode 1*a* was decreased. All other conditions remained the same as in the second preferred embodiment. The head thus produced yielded the following wall thickness measurements: 1.8 to 3.2 mm at the face and sole regions and 0.3 to 0.7 mm at the crown region.

FOURTH PREFERRED EMBODIMENT

A fourth preferred embodiment is described next. As shown in FIG. 5, a driver head No. 1 was produced by using the outer electrode 1, consisting of three sectional electrodes for the face, sole and crown sections, and one inner electrode 3. The sectional electrodes were all made of nickel and the inner electrode 3 was made of epoxy resin having an electrode surface composed of electroless nickel. The support was provided at the hosel section, as was the electrical contact. The sectional electrodes were supported by aluminum jigs (not shown) having an insulated section made of fluorocarbon polymers, and were supplied, independently and separately, with the deposition current. The deposition arrangement was made as shown in FIG. 5 and the distances between the sectional electrodes and the inner electrode 3 were kept uniform.

A sulfamic electrolyte bath having a pH of 4.0 was prepared by dissolving 500 g/L of nickel sulfamic acid, 10 g/L of nickel chloride, 30 g/L of boric acid. In this bath maintained at 50° C., said electrodes were arranged and deposition was carried out under the following conditions: current densities of 20 A/dm$^2$ to each of the face and sole electrodes, and 5 A/dm$^2$ for the crown electrode.

When the operation was completed, the outer sectional electrodes were removed and the inner electrode 3 was thermally decomposed at 400° C. for three hours.

The wall thicknesses were 2 to 2.5 mm at the sole and the face sections, and 0.5 to 0.7 mm at the crown section.

FIFTH PREFERRED EMBODIMENT

A fifth preferred embodiment is described next. An exact duplicate resin model, of the head to be produced, was made. From this model, an outer electrode having an internal surface which duplicates the exact external features of the head was produced. The inner surface of this electrode was coated with an electroless nickel film deposit. As shown in FIG. 4, the outer sectional electrodes in this preferred embodiment lacked the electrode corresponding with the sole section.

An undersized inner electrode 3 having a similar configuration was made of aluminum whose surface has been plated with platinum. The distances between the outer and inner electrode were 5 mm at the face section and 10 mm at the crown section.

A sulfamic electrolyte bath having a pH 3.5 was prepared by dissolving 500 g/L of nickel sulfamic acid, 30 g/L of cobalt sulfamic acid, 15 g/L of cobalt chloride, 30 g/L of boric acid. In this bath maintained at 50° C., the said electrodes were arranged and the deposition was carried out at a current density of 20 A/dm$^2$ to deposit Ni-Co alloys on the outer electrode.

When the operation was completed, the outer electrode was thermally decomposed by heating at 400° C. for three hours, and the inner electrode 3 was dissolved in nitric acid and the film of platinum was removed with a pair of tweezers.

The wall thicknesses were 2.2 to 2.6 mm at the face section and 0.5 to 0.7 mm at the crown section.

This technique permits deposition of metal and metal composite materials on the inner surface of the outer electrode, thus permitting duplication of score lines and other surface features of a head.

SIXTH PREFERRED EMBODIMENT

A sixth preferred embodiment is described next. An inner electrode 3 and three external sectional electrodes, corresponding to the face, sole and crown sections, were prepared identically to those used in the fourth preferred embodiment, except that the electrode material was made of platinum. The arrangement was as shown in FIG. 6, in which an electrolyte supply tubing was placed in between the face electrode 1*b* and the sole electrode 1*c* to supply the electrolyte in such a way to provide higher fluid flow to the areas near the electrodes 1*b* and 1*c* than that to the area near the electrode 1*a*.

A sulfamic acid electrolytic bath having a pH of 4 was prepared, consisting essentially of 0.15 mole/L of chromic sulfamic acid, 0.01 mole/L of nickel sulfamic acid, 0.40 mole/L of iron (I) sulfamic acid, 0.01 mole/L of cupric sulfamic acid, 0.1 mole/L of niobium chloride, 0.25 mole/L of potassium citrate, and 0.06 mole/L of potassium fluoride The deposition of stainless steel was carried out at a bath temperature of 50° C. and a current density of 2.5 A/dm$^2$.

When the operation was completed, the electrodes were removed in the same manner as in the fourth preferred embodiment.

Figure 7:
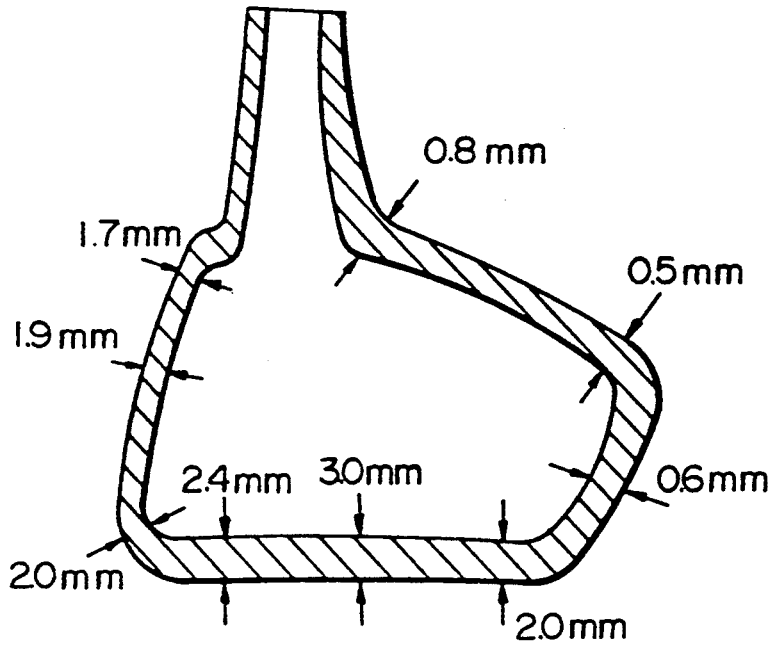
FIG. 7 is a cross sectional view to show the variations in the wall thickness of a head body produced by the invented technique.
Figure 8:
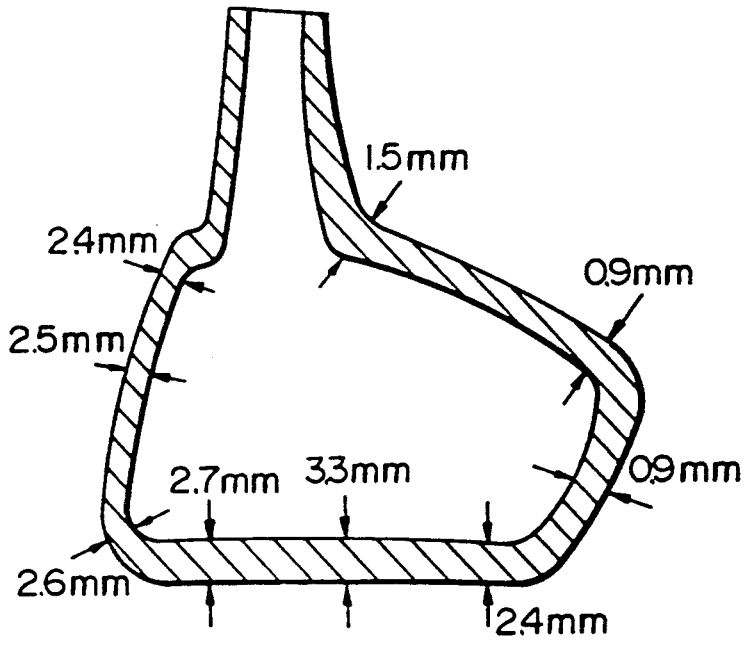
FIG. 8 is a cross sectional view to show the variations in the wall thickness of a head body made by the conventional casting techniques.

The wall thicknesses of the head body at the various sections were 1.7 to 3.0 mm at the face and sole sections and 0.5 to 0.8 mm at the crown sectional. In FIG. 7 and FIG. 8, the wall thickness distributions are shown in detail.

This technique has the advantage of simple circuitry because it does not require individual control of the current densities in the various sections.

The variations in the wall thickness of the head bodies made by the procedure described in the sixth preferred embodiment and by the conventional technique are shown in FIG. 7 and 8 respectively.

It was confirmed from these results that the invented technique is capable of producing thin wall head body compared with the conventional technique.

SEVENTH PREFERRED EMBODIMENT

A seventh preferred embodiment is described in the following.

A nickel-matrix SiC composite head was prepared in a sulfamic acid electrolyte bath consisting essentially of 500 g/L of nickel sulfamic acid, 10 g/L of nickel chloride, 30 g/L of boric acid and fine particles of SiC dispersed in the bath at a concentration of 10 g/L. All other conditions remained the same as in the fourth preferred embodiment.

The wall thicknesses of the head body thus produced were as follows: 2.0 to 2.5 mm in the face and sole sections, and 0.5 to 0.7 mm in the crown section.

In the following are described some of the tests and test results on test samples and on the sample golf clubs equipped with the head made by the technique disclosed in this invention.

Test No. 1.

Test specimens were prepared using the same sulfamine electrolyte composition as the one used in the fourth preferred embodiment. The anode and cathode electrodes were made of flat plates but the quality of materials and the method of removal were identical to those used in the fourth preferred embodiment.

The test results are compared in Table 1 for the two types of test specimens prepared by the electrolytic deposition and by rolling techniques.

TABLE 1

| | Preferred Embodiment No. 4 | Rolling |
|---|---|---|
| Tensile Strength | 50 Kg/mm$^2$ | 35 Kg/mm$^2$ |
| 0.2% Offset Proof Stress | 36 Kg/mm$^2$ | 13 Kg/mm$^2$ |
| Hardness (Vickers) | 170 | 70 |

The above results demonstrate that the material produced by the invented technique has high strength and hardness and is a material ideally suited for making golf club heads.

Test No. 2

Test specimens were prepared using the same sulfamine electrolyte composition as described in the sixth preferred embodiment and the test specimens were produced in the same manner as in Test No. 1.

The properties of the samples so prepared were compared against the samples of the same composition prepared by casting (namely, the same composition as SUS 630).

TABLE 2

| | Preferred Embodiment No. 6 | Casting |
|---|---|---|
| Tensile Strength | 98 Kg/mm$^2$ | 88 Kg/mm$^2$ |
| 0.2% Offset Proof Stress | 55 Kg/mm$^2$ | 44 Kg/mm$^2$ |
| Hardness (Vickers) | 520 | 400 |

The above results demonstrate that the material produced by the invented technique has high strength and hardness and is material ideally suited for making golf club heads.

Test No. 3

A metal head driver was made by adapting the chromium head made in this invention to the stainless steel shaft (made by True Temper Co., Dynamic gold model hardness S).

This experimental driver was attached to a robotic golfer, and range testing was carried out, at a headspeed of 40 m/s, by hitting 100 golf balls of a commercial brand (2-Piece Ball).

For comparison, a stainless steel head made by conventional casting technique was attached to the same shaft and tested using the same conditions.

The results of flight test distances are shown in Table 3. In the table, the flight distance are designated as: S for shortest, A for average and L for longest distances, all measured in meters.

TABLE 3

| | Units: meters | | | | | |
|---|---|---|---|---|---|---|
| | Carry | | | Carry + Run | | |
| | S | A | L | S | A | L |
| Chrome Head (Invention) | 216 | 228 | 235 | 260 | 270 | 278 |
| Cast Head | 203 | 218 | 230 | 245 | 261 | 274 |

In order to test the directional stability, the distance was measured between the resting point of the ball, along a line perpendicular to the line joining the tee with the objective point, and the intersecting point on said line with the flight line. The results are tabulated in Table 4.

TABLE 4

| | Units: meters | |
|---|---|---|
| | Carry | Carry + Run |
| Chrome head, (Invention) | 18 | 23 |
| Cast head, meter | 21 | 27 |

From Tables 3 and 4, it is demonstrated that the heads made by the present invention are able to provide superior flight distances and directional stability. This is considered to result from the fact that the crown wall thickness can be made thin, providing an additional drive distance due to the elastic spring action of the crown wall.

The invented golf club head was made with a highly elastic chromium material and was made by a technique of electrolytic deposition which is not prone to producing structural defects. Therefore, it was possible to reduce the wall thickness sufficiently to achieve the required characteristics of long drive distances and high directional stability.

Test No. 4

The stainless steel head made in the sixth preferred embodiment was made into a driver.

This experiment driver was attached to a robotic golfer, and range testing was carried out, at a headspeed of 40 m/s, by hitting 10 golf balls of a commercial brand (2-Piece Ball).

TABLE 5

| | Units: meters | | | | | |
|---|---|---|---|---|---|---|
| | Carry | | | Carry + Run | | |
| | S | A | L | S | A | L |
| Stainless Steel Head, (Invention) | 209 | 223 | 233 | 250 | 267 | 276 |
| Cast Head, | 203 | 218 | 230 | 245 | 261 | 274 |

The above results demonstrate that a club equipped with a head made by the invented technique is able to provide superior driving ability as judged by the distance of "carry" and "carry plus run". This is because the crown wall thickness is made thin, and therefore, it is able to energize readily when hit by the ball, which is the main performance feature of a metal head.

Test No. 5

In this test, an amateur golfer compared the performance of two clubs, one equipped with the head made in the fourth test and the other equipped with the conventional cast head. Ten balls were hit with each club, and their flight distance X and the deviation distance Y from the central line of the fairway were measured. The averaged results are shown in Table 6.

TABLE 6

| | Units: meters | | | |
|---|---|---|---|---|
| | Carry | | Carry + Run | |
| | X | Y | X | Y |
| Preferred Embodiment 6 | 208 | 19 | 250 | 24 |
| Cast Head | 204 | 21 | 243 | 27 |

The above results demonstrate that the invented head is able to provide superior directional stability, in addition to longer flight distance, as judged by the decrease in the values of the deviation distance Y.

This is because the electrolytic deposition technique permits thin wall construction, and therefore, for a given weight of the head, the volume of the head could be increased from the typical conventional figure of 150 mL to the invented head figure of 170 mL, thus enlarging the area of the sweet spot.

From all of the foregoing test results, it has been demonstrated that the invented adaptation of the electrolytic deposition technique permitted the production of head bodies which are defect-free and thin-walled thereby producing precision heads having superior performance characteristics, such as long flight distance and improved directional stability.

What is claimed is:

1. A metal head for golf clubs produced according to a method comprising the steps of:

(a) preparing electrodes having at least one electrically conductive surface thereon;

(b) filling a space between said electrodes with an electrolyte containing at least one ionic species of metallic material; and (c) electrolytically depositing said metallic material on said conductive surface so as to form a metallic layer on the surface, thereby forming a metal head.

2. A metal head for golf clubs according to claim 1, wherein said metallic material contains at least one of the elements selected from the group consisting of chromium, nickel, nickel-cobalt alloy, nickel-phosphorus alloy, iron, iron alloys and other alloys of them.

3. A metal-matrix composite head for golf clubs produced according to a method comprising the steps of:

(a) preparing electrodes having at least one electrically conductive surface;

(b) filling a space between said electrodes with an electrolyte containing at least one ionic species of a metallic material and fine particles of a nonmetallic material suspended within said electrolyte; and (c) electrolytically codepositing said metallic material and non-metallic fine particles on the electrically conductive surface of the electrode so as to form a layer consisting substantially of the metallic material matrix and the non-metallic material dispersed in said metallic matrix material.

4. A head for golf clubs according to either of claims 1 and 3, wherein the thickness of the layer varies depending on the locality of the head.

5. A method for manufacturing a metal head for golf clubs, the process comprising the steps of:

(a) preparing electrodes having at least one electrically conductive surface thereon;

(b) filling a space between said electrodes with an electrolyte containing at least one ionic species of metallic material; and (c) electrolytically depositing said metallic material on said conductive surface so as to form a metallic layer on the surface, thereby forming a metal head.

6. A method according to claim 5, and wherein said process further comprises the steps of:

preparing an outer electrode configured to a shape of a head object, and an inner electrode similarly configured and contained within and spaced apart from said outer electrode with a controllable amount of spacing, creating a volume of space therebetween, and wherein said process further comprises;

a step of filling the said volume of space with an electrolyte solution containing at last a metal ion species selected for the construction of a metal head body and a step of applying the electrical power, said electrical power being measured in terms of electric current density, to said outer and inner electrode so as to deposit said species of metallic materials to either of outer and inner electrodes.

7. A method according to claim 6, wherein said outer electrode has a surface configured to duplicate a conjugate impression of said head object, wherein said layer is formed on said surface configured to said head object.

8. A method according to claim 6, wherein said inner electrode is dimensionally configured to be smaller than said outer electrode by an amount equal to a thickness of said head object, wherein said layer is formed on said surface approximately configured to said head object.

9. A method according to either of claims 7 and 8, wherein either of the outer electrode and inner electrode is made into at least one separated sectional electrode each one of which is controlled individually and independently by varying the deposition conditions, either singly or in combination, of said process to produce sectional regions having different wall thicknesses.

10. A method according to claim 9, wherein said current density is varied to produce a variation in the wall thicknesses of the corresponding deposited parts of said head body.

11. A method according to claim 9, wherein said controllable spacing is varied to produce a variation in the wall thicknesses of the corresponding deposited parts of said head body.

12. A method according to claim 9, wherein the flow volume of said electrolyte to said spaces is varied to produce a variation in the wall thicknesses of corresponding deposited parts of said head body.

13. A method according to claim 9, wherein either of said outer electrode and said inner electrode is divided into sectional electrodes and wherein said process includes the steps of;

controlling the current density to at least either said sectional electrodes individually and independently, controlling the spacing between said outer and inner electrodes and controlling the flow volume of electrolyte solution to at least one volume of space of said sectional electrodes to produce at least one sectional region having different properties.

14. A method for manufacturing a metal-matrix composite head for golf clubs, the process comprising the steps of:

(a) preparing electrodes having at least one electrically conductive surface thereon;

(b) filling a space between said electrodes with an electrolyte containing at least one ionic species of a metallic material and fine particles of non-metallic material suspended within said electrolyte; and (c) electrolytically codepositing said metalic material and non-metallic fine particles on the electrically conductive surface of the electrode so as to form a metal-matrix composite layer consisting substantially of the metallic material matrix and the non-metallic material dispersed in said metallic matrix material.

15. A method according to claim 14, wherein said process further comprises the steps of:

preparing an outer electrode configured to a shape of a head object, and an inner electrode similarly configured and contained within and spaced apart from said outer electrode with a controllable amount of spacing creating a volume of space therebetween, and wherein said codeposition process further comprising the steps of;

a step of filling the said volume of space with an electrolyte solution containing at least the metal ion species selected for the construction of a metal head body and at least one non-metal fine particles dispersed in said electrolyte solution, and a step of applying the electrical power, said electrical power being measured in terms of the electric current density, to said outer and inner electrodes so as to codeposit said metal species and non-metal particles to either outer and inner electrodes.

16. A method according to claim 15, wherein said outer electrode has a surface configured to duplicate a conjugate impression of said head object, wherein said layer is formed on said surface configured to said head object.

17. A method according to claim 15, wherein said inner electrode is dimensionally configured to be smaller than said outer electrode by an amount equal to a thickness of said head object, wherein said layer is formed on said surface configured to said head object.

18. A method according to either claims 16 and 17, wherein either the outer electrode and inner electrode is made into at least one separated sectional electrode each either which is controlled individually and independently by varying the deposition conditions, either singly or in combination, of said process to produce sectional regions having different wall thicknesses.

19. A method according to claim 18, wherein said current density is varied to produce a variation in the wall thicknesses of the corresponding deposited parts of said head body.

20. A method according to claim 18, wherein said controllable spacing is varied to produce a variation in the wall thicknesses of the corresponding deposited parts of said head body.

21. A method according to claim 18, wherein the flow volume of said electrolyte to said spaces is varied to modify the wall thicknesses of corresponding deposited parts of said head body.

22. A method according to either claim 18, wherein either of said outer electrode and said inner electrode is divided into sectional electrodes and wherein said process includes the steps of controlling the current density to at least either said sectional electrodes individually and independently, controlling the positioning of at least either said sectional electrodes individually and independently, and controlling the flow volume of electrolyte solution to at least one volume of space of said sectional electrodes to produce at least one sectional region having different properties.

* * * * *

UNITED STATES PATENT AND TRADEMARK OFFICE

CERTIFICATE OF CORRECTION

PATENT NO. : 5,131,986

DATED : July 21, 1992

INVENTOR(S) : Mutsumi HARADA et al

It is certified that error appears in the above-identified patent and that said Letters Patent is hereby corrected as shown below:

On the Title page, item [75], delete "Toshi haru Hoshi" and insert -- Toshiharu Hoshi; --.

Signed and Sealed this

Seventeenth Day of August, 1993

Bruce Lehman

*Attest:*

BRUCE LEHMAN

*Attesting Officer*

*Commissioner of Patents and Trademarks*